US008631678B2

(12) United States Patent
Cao

(10) Patent No.: US 8,631,678 B2
(45) Date of Patent: Jan. 21, 2014

(54) PRESS MOLD

(75) Inventor: Jianghuai Cao, Anhui (CN)

(73) Assignee: Chery Automobile Co., Ltd., Anhui (CN)

( * ) Notice: Subject to any disclaimer, the term of this patent is extended or adjusted under 35 U.S.C. 154(b) by 527 days.

(21) Appl. No.: 12/997,947

(22) PCT Filed: Jun. 15, 2009

(86) PCT No.: PCT/CN2009/072265

§ 371 (c)(1),
(2), (4) Date: Dec. 14, 2010

(87) PCT Pub. No.: WO2009/152751

PCT Pub. Date: Dec. 23, 2009

(65) Prior Publication Data

US 2011/0094286 A1 Apr. 28, 2011

(30) Foreign Application Priority Data

Jun. 16, 2008 (CN) ..... 2008 2 0094651 U

(51) Int. Cl.
*B21D 37/10* (2006.01)

(52) U.S. Cl.
USPC ..... 72/456; 72/453.13; 72/455; 72/481.2; 100/265

(58) Field of Classification Search
USPC ..... 72/340, 350, 351, 446, 447, 448, 72/453.13, 455, 456, 481.1, 481.2, 466.9, 72/482.91; 100/214, 157, 265; 83/532
See application file for complete search history.

(56) References Cited

U.S. PATENT DOCUMENTS

| | | | | | |
|---|---|---|---|---|---|
| 1,244,741 | A | * | 10/1917 | Johnson | 72/345 |
| 2,592,152 | A | * | 4/1952 | Johansen | 72/350 |
| 3,648,600 | A | | 3/1972 | Jaccard | |
| 3,782,166 | A | * | 1/1974 | Whistler et al. | 72/462 |
| 3,841,141 | A | * | 10/1974 | Rachwal | 483/28 |
| 3,942,431 | A | * | 3/1976 | Goff | 100/345 |
| 4,339,975 | A | * | 7/1982 | Carrieri | 83/617 |
| 4,774,865 | A | * | 10/1988 | Wallis | 83/128 |
| 5,218,901 | A | * | 6/1993 | Imanishi | 100/353 |
| 5,799,532 | A | * | 9/1998 | Lewis | 72/446 |
| 7,707,866 | B2 | * | 5/2010 | Lanterman et al. | 72/351 |
| 2004/0012132 | A1 | | 1/2004 | Roper | |

FOREIGN PATENT DOCUMENTS

| | | |
|---|---|---|
| CN | 2142763 | 9/1993 |
| CN | 2197146 | 5/1995 |
| CN | 2216872 | 1/1996 |
| CN | 1733384 | 2/2006 |

(Continued)

OTHER PUBLICATIONS

International Search Report; PCT/CN2009/072265; Sep. 17, 2009.

(Continued)

*Primary Examiner* — Edward Tolan
(74) *Attorney, Agent, or Firm* — Kilpatrick Townsend & Stockton LLP

(57) ABSTRACT

A press mold comprises lower mold (9), upper mold (3), working limiter (6) and rigid storing restrictor (2). The lower mold (9) and the upper mold (3) are coupled each other by guide post (1) having guiding function so that they can move relative to each other. The working limiter (6) and the rigid storing limiter (2) are located between the lower mold (9) and the upper mold (3). The press mold also includes at least one elastic storing limiter provided between the upper mold (3) and the lower mold (9).

11 Claims, 4 Drawing Sheets

(56) References Cited

FOREIGN PATENT DOCUMENTS

| | | | |
|---|---|---|---|
| CN | 201220253 | 4/2009 | |
| CN | 2011-P82812 | * 11/2011 | ..... B30B 15/02 |
| DE | 2440999 | 3/1976 | |
| WO | 2007070476 A2 | 6/2007 | |

OTHER PUBLICATIONS

European Search Report regarding a European counterpart application, Aug. 2013.

* cited by examiner

PRESS MOLD

This application claims the priority to Chinese patent application No. 200820094651.1, filed with the Chinese State Intellectual Property Office on Jun. 16, 2008 and titled "Stamping Die", which is hereby incorporated by reference in its entirety.

FIELD OF THE INVENTION

The present invention relates to a stamping die and in particular to a stamping die with a storing position-limiting mechanism.

BACKGROUND OF THE INVENTION

With the development of the automotive industry, competitions are intensified. And raising efficiency and reducing costs have become an issue that requires automobile manufacturers' attention. As one of the four major manufacturing processes, stamping plays an important role in automobiles production. Reducing production costs of stamping pieces and reducing die changeover time in coachwork manufacturing are one of the key tasks.

Dies used in automated production lines are normally stored in stacks, and can be installed to a press through a die loading process. While they are in storage, a position-limiting mechanism provided in the dies keeps elastic elements of the dies from being pushed and deformation.

Two conventional methods exist for position limiting of dies in storage. One uses solely a rigid storing limiter. In the die loading process, a slider of the press is adjusted by an operator according to a storing height of a die, so as to lock the die to the press; then, the rigid storing limiter is removed manually, and the slider is adjusted once again according to a working height of the die. This process requires a long die changeover time, and does not support automated die loading. Moreover, the operator has to enter the die working area, posing a serious risk to safety. The other method uses solely a nitrogen gas spring as an elastic storing limiter. This method may meet the requirement of automated die loading and save die loading time. However, when many dies are stacked, the nitrogen gas spring may be compressed too much, losing its function as a storing limiter and causing damages to elastic elements of the dies. Using a nitrogen gas spring with a higher stiffness may allow the stacking of dies, but may also raise costs of the dies significantly and cannot prevent potential gas leak and failure due to long working hours of the dies; hence it cannot prevent damages to elastic elements of the dies.

SUMMARY OF THE INVENTION

A technical problem to be solved by the invention is to cure the deficiencies in the prior art, and to provide a stamping die that supports automated die loading and can prevent elastic elements from being damaged when the dies are stored in stacks.

The technical problem of the invention is solved by the technical solution described as below.

A stamping die, includes: a lower die; a direction-guiding guide pillar, arranged on the lower die, an upper die, connected with the lower die via the guide pillar; a working position limiter; and a rigid storing limiter, arranged on the lower die. The stamping die further includes at least one elastic storing limiter arranged between the upper die and the lower die.

The elastic storing limiter may be a nitrogen gas spring.

The stamping die may further include an elastic position limiter cushion arranged between the nitrogen gas spring and the upper die.

A counterbore matching the nitrogen gas spring may be provided in a lower face of the elastic position limiter cushion that is in contact with the nitrogen gas spring.

An elastic position limiter cushion storing hole for containing the elastic position limiter cushion may be arranged on the lower die.

The elastic position limiter cushion may be provided with a first steel chain for connecting the elastic position limiter cushion and the lower die.

The rigid storing limiter may be provided with a second steel chain for connecting the rigid storing limiter and the lower die.

A rigid storing limiter storing hole for containing the rigid storing limiter may be arranged on the lower die.

Advantageous effects of the invention over the prior art include: the stamping die includes an elastic storing limiter between the upper die and the lower die in addition to the rigid storing limiter, therefore, if many stamping dies are stacked or if the nitrogen gas spring is degraded after long working hours, the rigid storing limiter can provide the position-limiting function; moreover, prior to die loading and after the stamping die is hoisted to the work platform, the rigid storing limiter can be turned over manually, within the space for the rigid storing limiter after the nitrogen gas spring is relaxed, hence enabling automated die loading. The technical solution of the invention meets the requirement of die stacking, and meets the requirement of automated die loading, thereby saving die changeover time and lowering production costs.

DETAILED DESCRIPTION OF THE INVENTION

The invention is described in details through its embodiments in conjunction with the accompany drawings.

Figure 1:
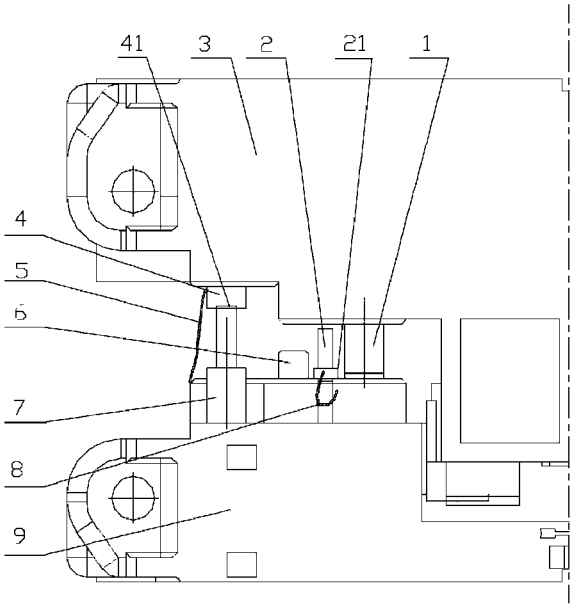
FIG. 1 is a sectional view of a stamping die according to the invention while it is stored separately.
Figure 2:
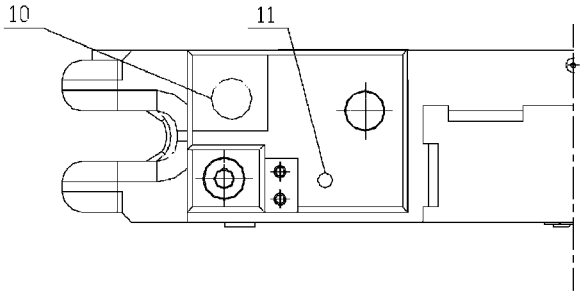
FIG. 2 is a top view of a lower die according to the invention.

As shown in FIG. 1 and FIG. 2, a stamping die of the invention includes: a guide pillar 1 for direction guiding, a rigid storing limiter 2, an upper die 3, an elastic position limiter cushion 4, a first steel chain 5, a working position limiter 6, an elastic storing limiter, a second steel chain 8, and a lower die 9. An elastic position limiter cushion storing hole 10 for containing the elastic position limiter cushion 4, and a rigid storing limiter storing hole 11 for containing the rigid storing limiter 2 are provided on the lower die 9.

The upper die 3 and the lower die 9 are connected and directed to move relatively through the guide pillar 1. The working position limiter 6 is arranged on the lower die 9, for position limiting while the stamping die is working. The elastic storing limiter is arranged on the lower die 9, and according to an embodiment of the invention, may be a nitrogen gas spring 7. The elastic position limiter cushion 4 is provided between the nitrogen gas spring 7 and the upper die 3. A counterbore 41 matching the nitrogen gas spring 7 is provided at the lower end of the elastic position limiter cushion 4 that is in contact with the nitrogen gas spring 7. The depth of the counterbore 41 may range from 3 mm to 5 mm. The elastic position limiter cushion 4 is connected to the lower die 9 via the first steel chain 5. In a preferred embodiment, four nitrogen gas springs 7 are arranged at the four corners of the stamping die, respectively. The rigid storing limiter 2 is connected to the lower die 9 via the second steel chain 8. A boss 21 is provided at the lower end of the rigid storing limiter 2. In an embodiment of the invention, the height of the boss 21 is around 5 mm.

The heights of the nitrogen gas spring 7 and the rigid storing limiter 2 are calculated and selected based on the size, weight, and length of travel of the stamping die, so that while the stamping die is stored separately the distance between the rigid storing limiter 2 and the upper die 3 is 15 mm or so larger than the distance between the upper end of the elastic position limiter cushion 4 and the upper die 3. And the distance between the rigid storing limiter 2 and the upper die 3 is larger than the distance between the working position limiter 6 and the upper die 3. The elastic position limiter cushion storing hole 10 and the rigid storing limiter storing hole 11 are provided on the lower die 9. The elastic position limiter cushion storing hole 10 is for containing the removed elastic position limiter cushion 4. And the rigid storing limiter 2 may be stored in the rigid storing limiter storing hole 11 after it is turned over, and the height of the rigid storing limiter 2 now is lower than the height of the working position limiter 6.

Figure 3:
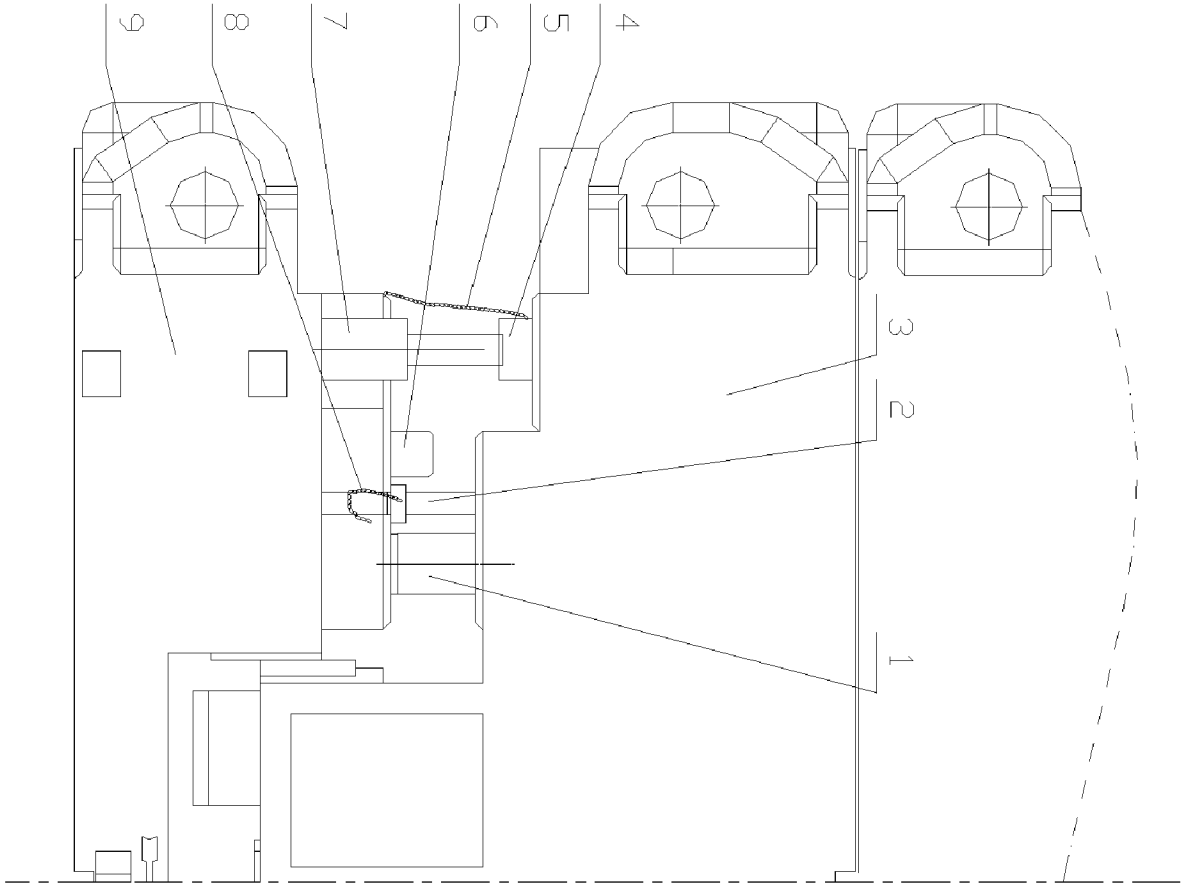
FIG. 3 is a sectional view of a stamping die according to the invention while it is stacked with many other dies.

As shown in FIG. 1, while the stamping die is stored separately, the nitrogen gas spring 7 provides the position-limiting function, and keeps elastic elements of the die from being damaged. As shown in FIG. 3, when stamping dies are stored in stacks, if their weight does not exceed the limit of the nitrogen gas spring 7, it is still the nitrogen gas spring 7 that provides the position-limiting function; and if the weight on the nitrogen gas spring 7 is about to exceed the limit, the nitrogen gas spring 7 is compressed and it is the rigid storing limiter 2 that supports the stamping dies above, thereby effectively protecting elastic elements of the dies.

Figure 4:
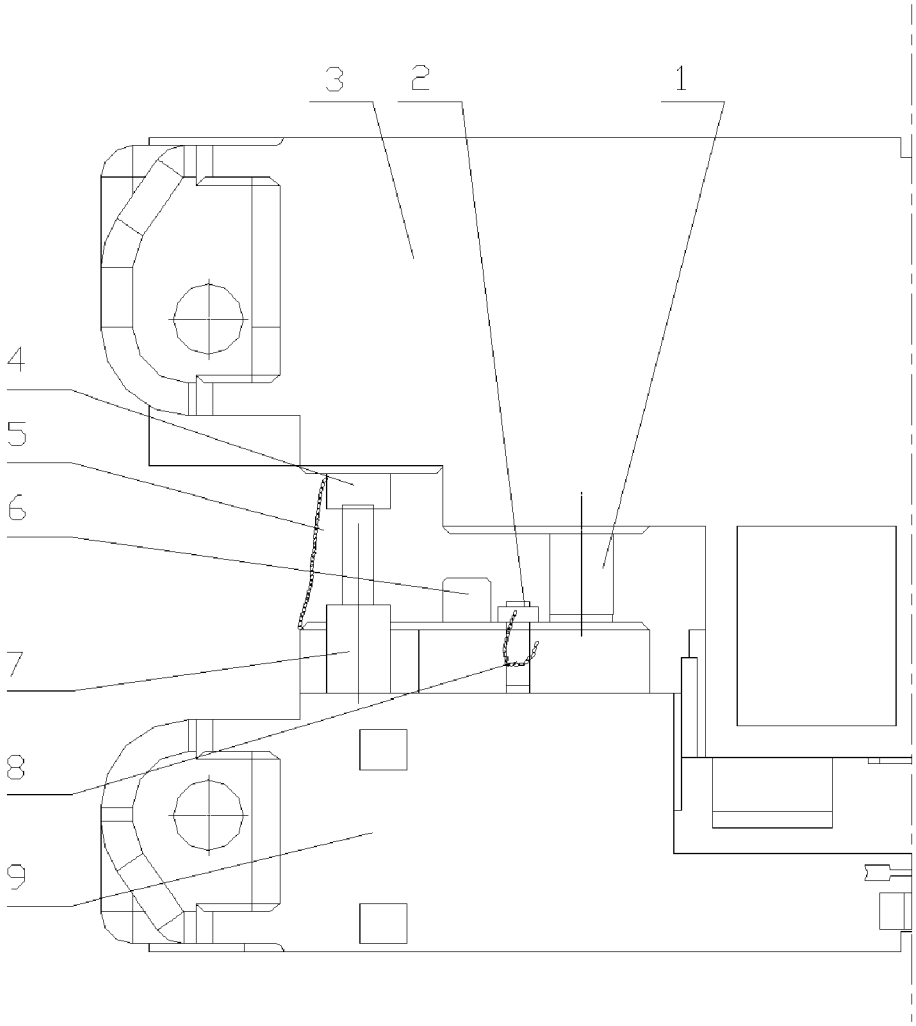
FIG. 4 illustrates the placement of a rigid storing limiter of a stamping die according to the invention before it is installed to a press.
Figure 5:
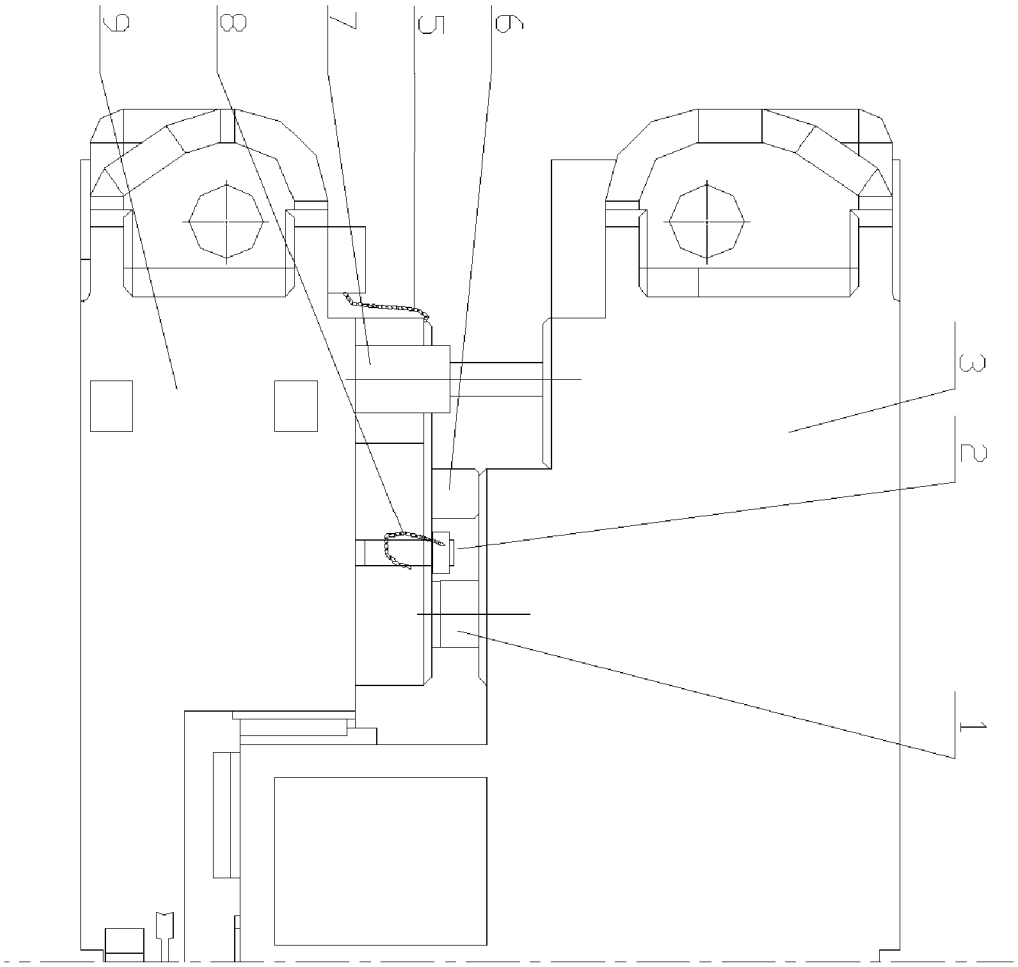
FIG. 5 illustrates a stamping die according to the invention while it is working.

Operations of the invention are described as below. When a stamping die is to be put online, stamping dies that are stacked above it are hoisted away, and the stamping die is hoisted to an auxiliary work platform. As shown in FIG. 4, since the stamping dies stacked above have been removed, the nitrogen gas spring 7 is relaxed to the position where the stamping die is stored separately, and the distance between the upper die 3 and the rigid storing limiter 2 is 15 mm, which, with the 5 mm of the boss 21 at the lower end of the rigid storing limiter 2 subtracted, leaves 10 mm. The space allows for turning over of the rigid storing limiter 2 before the stamping die enters the press, with performance degradation of the nitrogen gas spring 7 after long working hours being taken into account. And the height of the rigid storing limiter 2 after it is turned over is lower than the height of the working position limiter 6, thereby avoiding affecting working of the stamping die. As shown in FIG. 5, while the stamping die is working, the elastic position limiter cushion 4 is removed and placed in the elastic position limiter cushion storing hole 10, and the rigid storing limiter 2 is turned over and placed in the rigid storing limiter storing hole 11, which ensures that the upper die 3 only contacts with the nitrogen gas spring 7 and working limiter 6 when the upper die 3 moves down, and the nitrogen gas spring 7 now functions as a buffer. Prior to putting the stamping die offline, the elastic position limiter cushion 4 is taken out of the elastic position limiter cushion storing hole 10, and placed on the nitrogen gas spring 7. Because of the counterbore 41 at the lower end of the elastic position limiter cushion 4, the elastic position limiter cushion 4 is steady on the nitrogen gas spring 7, and the length of travel of the nitrogen gas spring 7 is reduced. Then, the rigid storing limiter 2 is turned back to its storing state, and one of the ends that has the boss 21 is placed in the rigid storing limiter storing hole 11; now the stamping die can be closed and put offline to the stamping die storing state.

The stamping die of the invention can be used in automated stamping lines, preventing elastic elements from being damaged while the stamping dies are stored in stacks, and enabling automated die changing. The invention is highly practicable and compatible, may save stamping die production costs and is easy to be adopted. The invention has a structure easy to be manufactured, has a long service life, and costs little for maintenance.

Detailed description of the invention is described above in connection with particular preferred embodiments. It should be noted that embodiments of the invention are not limited to the description above. Those skilled in the art may make various modifications or alternations without deviation from the scope of the invention. Those modifications and alternations should be included in the scope of the invention.

The invention claimed is:

1. A stamping die, comprising: a lower die; an upper die; a working position limiter; and a rigid storing limiter, wherein the lower die and the upper die are connected via a guide pillar for direction-guiding, so that the lower die and the upper die are movable relatively, and the working position limiter and the rigid storing limiter are arranged between the lower die and the upper die, wherein, the stamping die further comprises at least one elastic storing limiter arranged between the upper die and the lower die, a rigid storing limiter storing hole for containing the rigid storing limiter is arranged on the lower die, a boss is provided at a lower end of the rigid storing limiter, and a diameter of the rigid storing limiter storing hole is smaller than a diameter of the boss of the rigid storing limiter and is larger than a diameter of an upper portion of the rigid storing limiter, and in a storing state of the stamping die, the rigid storing limiter is placed on the rigid storing limiter storing hole, with the boss abutting an upper surface of the lower die, and a distance from an end, away from the lower die, of the rigid storing limiter to the upper surface of the lower die is larger than a distance from a top end of the working position limiter to the upper surface of the lower die; and in a working state of the stamping die, the rigid storing limiter is turned over, with the upper portion being inserted in the rigid storing limiter storing hole, and a distance from an end, away from the lower die, of the rigid storing limiter to the upper surface of the lower die is smaller than the distance from the top end of the working position limiter to the upper surface of the lower die.

2. The stamping die according to claim 1, wherein the elastic storing limiter comprises a nitrogen gas spring arranged on the lower die.

3. The stamping die according to claim 2, wherein the elastic storing limiter comprises four nitrogen gas springs, the four nitrogen gas springs being arranged at four corners of the lower die, respectively.

4. The stamping die according to claim 2, wherein the stamping die further comprises an elastic position limiter cushion arranged between the nitrogen gas spring and the upper die.

5. The stamping die according to claim 4, wherein a counterbore matching the nitrogen gas spring is provided in a lower face of the elastic position limiter cushion that is in contact with the nitrogen gas spring.

6. The stamping die according to claim 4, wherein an elastic position limiter cushion storing hole for containing the elastic position limiter cushion is arranged on the lower die.

7. The stamping die according to claim 4, wherein the elastic position limiter cushion is provided with a first steel chain for connecting the elastic position limiter cushion and the lower die.

8. The stamping die according to claim 1, wherein the rigid storing limiter is provided with a steel chain for connecting the rigid storing limiter and the lower die.

9. The stamping die according to claim 2, wherein the rigid storing limiter is provided with a steel chain for connecting the rigid storing limiter and the lower die.

10. The stamping die according to claim 3, wherein the rigid storing limiter is provided with a steel chain for connecting the rigid storing limiter and the lower die.

11. The stamping die according to claim 4, wherein the rigid storing limiter is provided with a steel chain for connecting the rigid storing limiter and the lower die.

* * * * *